United States Patent [19]

Pottier et al.

[11] Patent Number: 4,718,836

[45] Date of Patent: Jan. 12, 1988

[54] RECIPROCATING COMPLETELY SEALED FLUID-TIGHT VACUUM PUMP

[75] Inventors: Daniel Pottier; Rémi Leclaire; Paul Vulliez, all of Pont Audemer, France

[73] Assignee: NORMETEX, Pont Audemer, France

[21] Appl. No.: 754,738

[22] Filed: Jul. 15, 1985

[30] Foreign Application Priority Data

Jul. 23, 1984 [FR] France ..... 84 11652

[51] Int. Cl.[4] ..... F04B 23/12; F04B 45/00

[52] U.S. Cl. ..... 417/205; 417/244; 417/413; 417/473; 417/525; 417/534; 92/37; 92/90; 92/99; 92/103 M

[58] Field of Search ..... 417/63, 261, 413, 472, 417/473, 523, 525, 534, 205, 244; 92/34, 35, 37, 45, 47, 90, 103 M, 99, 101

[56] References Cited

U.S. PATENT DOCUMENTS

| | | | |
|---|---|---|---|
| 1,195,133 | 8/1916 | Dalen | 92/47 X |
| 1,341,669 | 6/1920 | Porter | 92/45 X |
| 1,538,166 | 5/1925 | Cass | 92/47 X |
| 1,546,397 | 7/1925 | Michelsen | 92/47 X |
| 1,711,803 | 5/1929 | Munday | 92/103 M X |
| 1,992,139 | 11/1933 | Armstrong | 417/480 |
| 2,021,156 | 11/1933 | Smith | 417/472 |
| 2,220,902 | 11/1940 | Hastings et al. | 92/99 |
| 2,267,280 | 12/1941 | Kuhnel | 92/99 X |
| 2,578,265 | 12/1951 | Saalfrank | 417/63 |
| 2,668,656 | 2/1954 | Booth, Jr. et al. | 417/534 X |
| 2,791,372 | 5/1957 | Abbatiello | 417/472 X |
| 3,503,307 | 3/1970 | Migdal | 92/103 M X |
| 3,802,809 | 5/1972 | Vulliez | 418/5 |
| 3,947,156 | 3/1976 | Becker | 417/413 X |
| 4,594,058 | 6/1986 | Fischell | 417/413 |

FOREIGN PATENT DOCUMENTS

| | | | |
|---|---|---|---|
| 129157 | 7/1932 | Austria | 417/413 |
| 11445 | 5/1980 | European Pat. Off. | 417/534 |
| 802642 | 2/1951 | Fed. Rep. of Germany . | |
| 861732 | 1/1953 | Fed. Rep. of Germany | 92/34 |
| 1503436 | 9/1969 | Fed. Rep. of Germany | 92/34 |
| 795326 | 1/1936 | France | 92/34 |
| 1457688 | 9/1965 | France . | |
| 2141402 | 6/1971 | France | 418/5 |
| 2153129 | 9/1971 | France | 418/5 |
| 452718 | 10/1949 | Italy | 417/413 |
| 102449 | 8/1979 | Japan | 92/103 M |
| 1335407 | 10/1973 | United Kingdom | 417/472 |

*Primary Examiner*—Carlton R. Croyle
*Assistant Examiner*—Paul F. Neils
*Attorney, Agent, or Firm*—Perry Carvellas

[57] ABSTRACT

A completely dry fluid-tight reciprocating vacuum pump comprises one or more pumping chambers defined between two rigid parts which face one another in the axial direction. One is reciprocated in a straight line relative to the other. They are connected to one another by at least one axially flexible member of appropriate radial stiffness. Each of these members comprises an outside part fixed to a first of these rigid parts. The side of the first rigid part facing the flexible member is shaped to have a profile in diametral cross-section which is substantially the same as the profile in diametral cross-section that this member tends to assume, by virtue of its stiffness, in the configuration with the aforementioned rigid parts moved towards one another. The pump can be used for pumping corrosive and radioactive gases, such as tritium, for example.

19 Claims, 10 Drawing Figures

RECIPROCATING COMPLETELY SEALED FLUID-TIGHT VACUUM PUMP

BACKGROUND OF THE INVENTION

1. Field of the invention

The present invention concerns a completely dry fluid-tight vacuum pump.

2. Description of the prior art

Completely dry pumps of the type with spirals rendered fluid-tight by metal bellows are already known. Pumps of this kind are described in particular in French Pat. Nos. 2,141,402 and 2,153,129 in the name Paul Vulliez and the corresponding patents No. DE-2,225,327 and U.S. Pat. No. 3,802,809. These pumps are capable of discharging at atmospheric pressure whilst achieving a residual limiting vacuum of approximately 10 Pa ($10^{-1}$ millibars).

These patents include proposals to associate these dry spiral pumps with synthetic material diaphragm pumps, which makes it possible to achieve a limiting vacuum of approximately $10^{-1}$ Pa ($10^{-3}$ millibars). However, this solution is limited to pumping gases compatible with the nature of the synthetic material diaphragm; it is not applicable to the pumping of corrosive or radioactive gases such as those used, for example, in uranium enrichment or thermonuclear fusion processes, where only pumping members made entirely of metal may be used.

Also known are dry vacuum pumps employing alternating compression of metal bellows which, in association with spiral pumps of the aforementioned type, enable corrosive and radioactive gases to be pumped to a limiting vacuum of the same order of magnitude ($10^{-1}$ Pa). The performance capabilities of these bellows type pumps are limited, however, due to the residual volumes which inevitably remain in the vicinity of the bellows.

Finally, there are known other types of diaphragm pumps as described, for example, in French Pat. No. 1,457,688 or U.S. Pat. No. 2,021,156.

The devices described in these patents are equipped with one or more rigid rings mounted loosely in the inside fold or folds of the diaphragm. Apart from the disadvantages already mentioned resulting in certain cases from the use of synthetic material diaphragms, the presence of the rings results in rapid wear of the diaphragm making this type of device unsuitable for the applications more particularly envisaged in the context of the invention.

An object of the present invention is a new type vacuum pump the pumping members of which are metal and which offers improved performance. The invention is directed to a new reciprocating dry pump featuring simple and rugged construction and trouble-free operation, achieving high performance in terms of limiting vacuum through virtually total expulsion of the pumped gas on each compression cycle.

The invention is also directed to a reciprocating dry pump which, in association with a dry spiral pump of the aforementioned type, provides for pumping all gases, including corrosive and radioactive gases, with a significant improvement in terms of limiting vacuum and discharge pressure as compared with known dry pumps.

SUMMARY OF THE INVENTION

The present invention consists in a completely dry fluid-tight vacuum pump comprising at least one variable volume pumping chamber having an intake, an outlet, a fixed axial end wall and a mobile axial end wall, non-return means adapted to procure one-way flow of fluid from said intake to said outlet, at least one radially stiff and axially flexible circular metal member in said chamber having an outside part fixed to a rigid part of said chamber and adapted to be applied against one of said axial end walls, and a mobile assembly to which said circular metal member is fixed and which is adapted to move axially to and fro between a position with said axial end walls moved apart and a position with said axial end walls moved together, wherein said circular metal member and said axial end wall against which it is applied have substantially the same diametral profile in said position with said axial end walls moved together so that the residual space between them is as small as possible.

The matching of the profile of the rigid parts of the pumping chamber to the profile which the flexible metal member takes up in the configuration with the axial end walls moved together permits virtually total expulsion of the gas situated in the pumping chamber, the residual volume of the latter being in this way reduced to the minimum.

The invention is further directed to a dry pump with double metal isolation from the surrounding atmosphere achieved by installing a safety bellows around the flexible metal member and attaching it to the rigid parts. There is created in the resulting fluid-tight annular volume a carefully chosen pressure significantly less than atmospheric pressure, this constituting a simple way of achieving the following two remarkable results:

1. Monitoring of any accidental leakage from any of the flexible metal members by placing this fluid-tight volume in communication with a pressure monitoring and alarm switch.

2. Reduction of the fatigue effects to which the flexible metal pumping member is exposed when its outside parts are exposed directly to atmospheric pressure.

The flexible metal pumping member may be of annular form with a substantially toroidal transverse cross-section, in which case it may be fabricated in a single piece, like a bellows element, or in two pieces by fastening together along their inside edges two preformed metal diaphragms having a substantially half-toroidal transverse cross-section, that is to say one which is open radially outwards (see FIGS. 1 and 2). This type of substantially toroidal shaped flexible member is more suitable where the mobile pumping member travel is relatively small and for achieving relatively high discharge pressures.

This type of dry pump may advantageously be equipped with another form of flexible metal member obtained from a circular disk preformed in the unstressed position, with a diametral profile conferring the best performance in terms of axial flexibility for minimum fatigue effects. The fastening together back-to-back of two of these disks in their central part makes it possible to retain the stated flexibility advantages for the same travel of each of them whilst doubling the pumping chamber volume. In this case the method of fastening together the centers of the two disks must provide a hole establishing communication between the two parts of the same pumping chamber.

As already indicated, the use of the vacuum pump in accordance with the invention is of particular benefit when associated with spiral type pumps as mentioned above.

In this case the completely dry limiting vacuum achieved may be as low as $10^{-2}$ to $10^{-3}$ Pa ($10^{-4}$ to $10^{-5}$ millibars), in conjunction with a significantly high discharge pressure, depending on the type of flexible member employed.

The characteristics and advantage of the invention will emerge from the description of examples of the invention which will now be given by way of example and with reference to the accompanying drawings.

DESCRIPTION OF THE PREFERRED EMBODIMENTS

Figure 1:
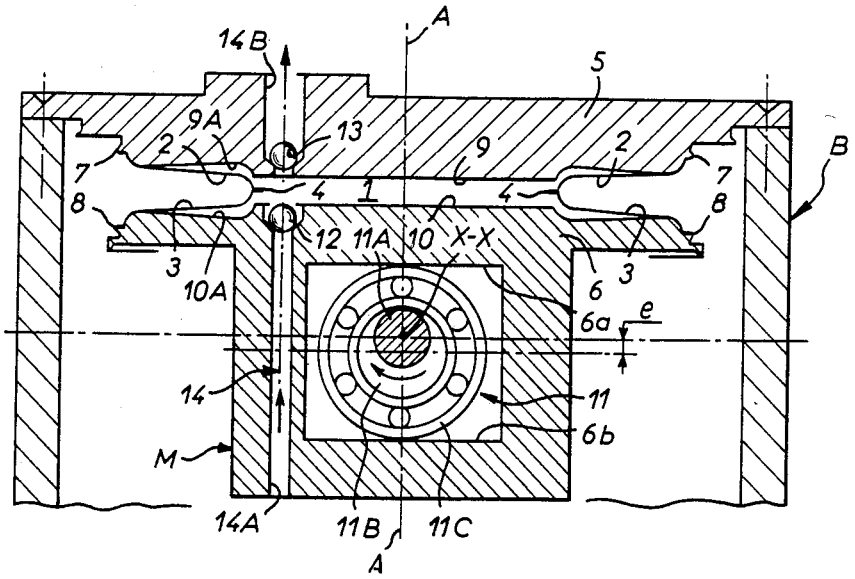
FIG. 1 is a schematic view in axial cross-section of part of a pump in accordance with the invention in which the flexible metal pumping member, consisting of an annular element of substantially toroidal transverse cross-section obtained by fastening together two diaphragms, is disposed between a fixed rigid wall and a mobile rigid wall so as to pump out the space comprised between the annular member and the two rigid parts.

FIG. 1 shows, by way of non-limiting example, part of a completely dry and fluid-tight vacuum pump of the reciprocating rectilinear compression type adapted in accordance with the invention to pump all sorts of fluid, even corrosive or radioactive ones.

The pump comprises a pumping chamber 1 the variable volume of which is comprised within the interior of a circular, in this instance specifically annular, metal member of substantially toroidal transverse cross-section, open outwardly, flexible axially and formed here by two flexible metal annular diaphragms 2 and 3 fastened together back-to-back by their inside circular edges 4. This chamber is delimited by two rigid parts 5 and 6 facing each other in the axial direction, defining the axial end walls of the pumping chamber and subjected to reciprocating rectilinear axial movement relative to one another along an axis A—A between a moved apart configuration and a moved together configuration. The annular member 2–3 is connected, as by welding, for example, through its outside circular edges 7 and 8 to the respective rigid parts. These rigid parts have central surfaces 9 and 10 with complementary profiles facing each other in the axial direction and, between these and the securing lines for the annular member, annular recesses 9A and 10A. The profile of these recesses 9A and 10A must be extremely accurate so that in the moved together configuration it may correspond exactly, apart from a very small clearance, to that then assumed by the flexible annular member 2, 3, the central surfaces 9 and 10, shown plane in FIG. 1, also mating, apart from the same very small clearance. By virtue of these arrangements the residual volume of the chamber 1 is reduced to the minimum.

In the pump shown by way of example in FIG. 1, the top rigid part 5 is fixed to a frame B.

The bottom rigid part forms part of a mobile assembly M driven by means of a so-called "frame" type eccentric mechanism 11, the axis X—X of which intersects the axis A—A at right angles. As shown the device 11 comprises a drive shaft 11A aligned with axis X—X fastened to an eccentric disk 11B engaged within a ball bearing 11C. The mobile rigid part 6 comprises two bearing areas *6a* and *6b* parallel to the central surface 10 between which is engaged with clearance the outside race of the ball bearing 11C.

When the eccentric 11 rotates from its low position as shown in FIG. 1, it exerts on the assembly M an upward axial thrust, any radial component of friction being eliminated by virtue of rolling cooperation of the ball bearing 11C with the bearing area *6a*. This upward movement continues as far as the position corresponding to the moved together configuration, after which rotation of the eccentric 11 results in a downward movement of the mobile assembly M, this continuing in cyclic manner. The axial displacement of the assembly M is defined by the eccentricity "e" of the eccentric 11.

In the rigid parts 5 and 6 are disposed ball-type non-return valves 12 and 13 procuring one-way flow of fluid in a tube 14 comprising an intake section 14A and an outlet section 14B.

In operation, on upward movement of the mobile assembly M, the flexible annular member 2–3 is progressively caused to mate with the surfaces of the areas 9A and 10A of the pumping chamber, neglecting a very small clearance, at the same time as the center surfaces 9 and 10 of this chamber also mate with one another, again ignoring a very small clearance. In this way virtually all of the gas is expelled through the outlet orifice.

Figure 2:
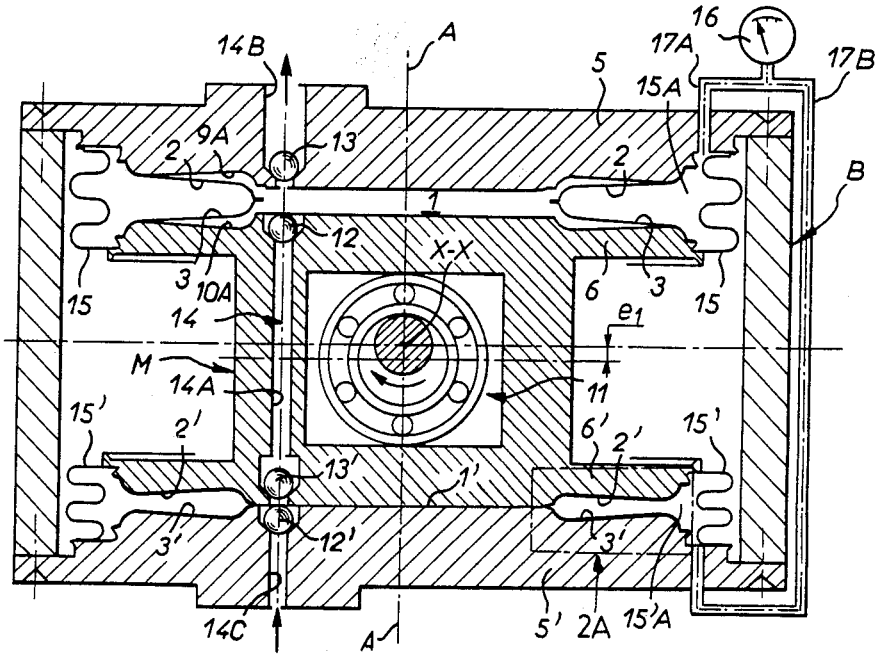
FIG. 2 is a view analogous to FIG. 1 in which the part of the pump shown in FIG. 1 is duplicated so that one of the pumping chambers is at the minimal volume when the other is at the maximal volume, providing for serial pumping.
Figure 2A:
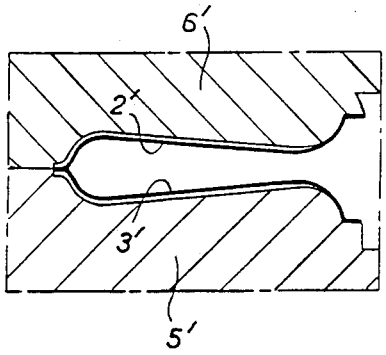
FIG. 2A is an enlarged detailed view of the portion 2A of FIG. 2 and illustrates the minimal residual space between the circular metal member and the respective axial end wall in the second closed together position while maintaining a very small clearance between the circular metal member and the respective axial end wall.

FIG. 2 shows a pump in accordance with the invention which comprises two pumping chambers 1 and 1' of the aforementioned type disposed in back-to-back arrangement. The same reference symbols have been used to designate, in respect of the upper pumping chamber 1, the same components as in FIG. 1, an analogous reference symbol followed by a "prime" suffix being used to designate the corresponding components of the lower pumping chamber 1'.

These chambers 1 and 1' are centered and aligned on the same axis A—A and the mobile parts 6 and 6' which, together with the fixed rigid parts 5 and 5' and the annular members 2–3 and 2'–3', define them are both fastened to the mobile assembly M which is guided axially relative to the frame B by the annular members 2–3 and 2'–3', by virtue of their radial stiffness in particular. As a result, these chambers perform compression cycles in phase opposition, as a result of which pumping takes place serially from chamber 1' to chamber 1.

The tube 14A which passes through the mobile assembly M constitutes an intake tube for the pumping chamber 1 and an outlet tube for the pumping chamber 1', which receives an intake tube 14C which is advantageously aligned with the tubes 14A and 14B which constitute the outlet tube of the chamber 1.

As a security measure, each of the annular members or flexible metal pumping members 2–3 and 2'–3' is preferably surrounded by a metal bellows 15 or 15' fixed to the fixed and mobile rigid parts 5, 6 to which said annular member is fixed. These annular members and these bellows define annular safety chambers 15A and 15' A which isolate the pumping chambers from the outside environment. These annular chambers are advantageously linked by connecting tubes 17A and 17B to a pressure switch 16 adapted to sense the pressure of the indicator gas contained in these chambers, which should remain between two limiting values, and to operate any form of control and safety system should this pressure go outside the permitted range of values. Thus the pressure switch makes it possible to detect any breakage of an annular member or of a bellows without direct communication being established between the inside of the pumping chambers and the outside surroundings. This results in a high level of security when pumping dangerous gases.

Advantageously, this same arrangement provides for reducing the fatigue stresses to which the flexible metal pumping members 2–3 and 2'–3' are subjected when their outside surfaces are directly exposed to atmospheric pressure, by maintaining the indicator gas in the chambers 15A and 15'A at a pressure significantly lower than atmospheric pressure. This appreciable advantage leads to an increase in the service life of the flexible metal pumping member and thus in the reliability of the pump assembly as a whole.

Figure 3:
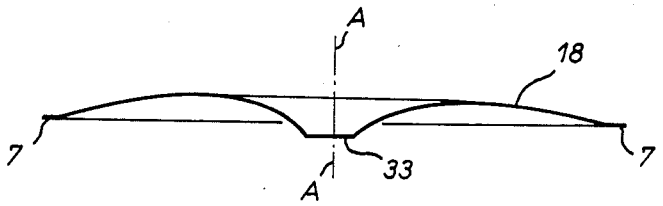
FIG. 3 is a view in diametral cross-section of a flexible metal pumping member obtained by preforming a single metal disk.

FIG. 3 shows a flexible metal pumping member 18 obtained from a solid disk preformed to a diametral profile permitting optimal axial flexibility, that is to say the optimum axial displacement for the minimum corresponding axial force.

More precisely, the required shape of the metal member 18 is determined by subjecting one of the surfaces of a solid metal disk to a predetermined hydrostatic pressure, the disk being retained at its periphery and at a circular central part 33. This simple shaping process makes it possible to obtain the diametral profile yielding the optimum axial flexibility, but it is not necessarily used industrially to produce the flexible members 18. These may be obtained, for example, by stamping similar disks using press tools shaped to reproduce the required profile, determined as indicated hereinabove. This pumping member 18 is designed to have its outside edge 7 attached to the fixed rigid part 5 and to be fastened centrally at 33, by any appropriate means, to the mobile assembly M (FIG. 5).

Figure 4:
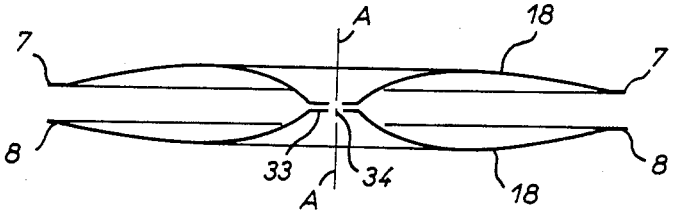
FIG. 4 is also a view in diametral cross-section of a flexible metal member, consisting of two members identical to that in FIG. 3 fastened together.

FIG. 4 shows a flexible metal member consisting of two members 18 identical to that of FIG. 3 fastened together by their respective central parts 33 so that their diametral profiles are substantially symmetrical relative to a plane transverse to the axial direction of displacement. The outside edges 7 and 8 are designed to be attached in fluid-tight manner, as by welding, for example, to the rigid parts 5 and 6, respectively, and the central parts 33 comprise a passage 34 for establishing communication between the two parts of the pumping chamber thus created.

Figure 5A:
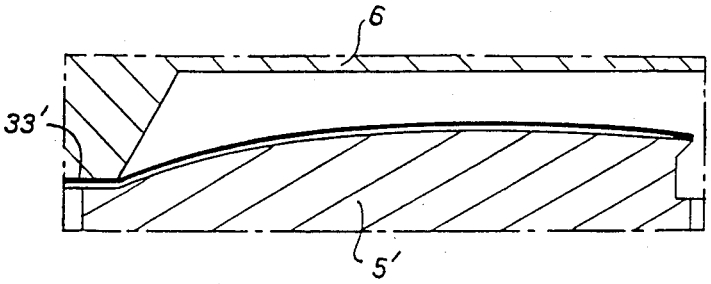
FIG. 5A is an enlarged detailed view of the portion 5A of FIG. 5 and illustrates the minimal residual space between the circular metal member and the respective axial end wall in the second closed together position while maintaining a very small clearance between the circular metal member and the respective axial end wall.
Figure 5:
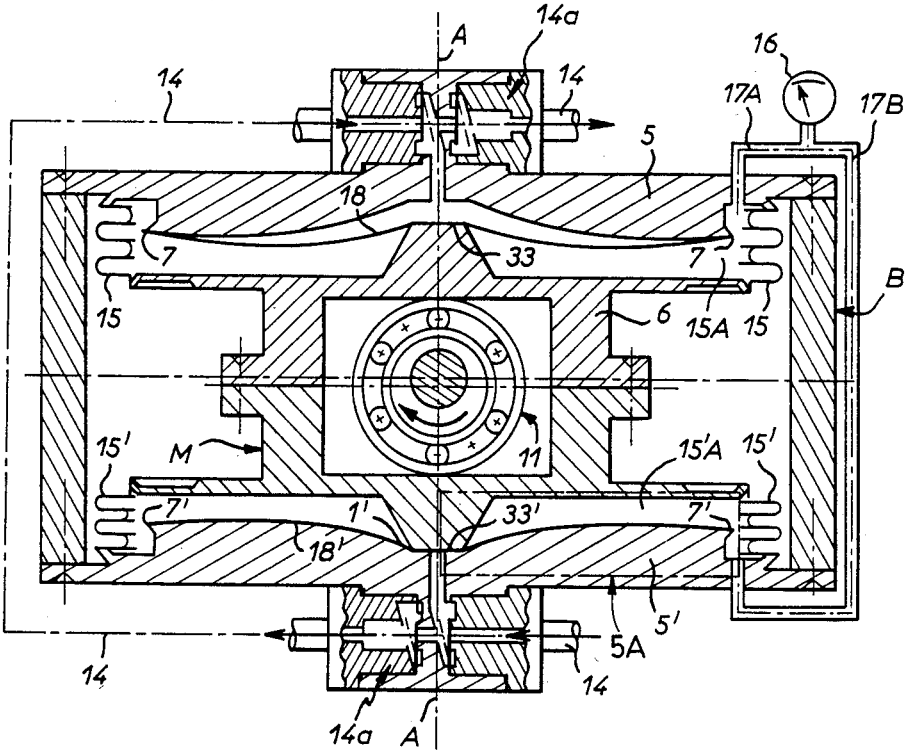
FIG. 5 is a schematic view in axial cross-section of a pump analogous to that shown in FIG. 2 but in which each of the two pumping chambers is equipped with a single flexible metal member as shown in FIG. 3, this figure also showing a valve arrangement different than that of FIG. 2.

FIG. 5 shows a dry pump assembly similar to that shown in FIG. 2, but in which the two pumping chambers 1 and 1' are comprised between the rigid parts 5 and 5' and the flexible pumping members consisting of two preformed metal disks as shown in FIG. 3. These unitary members 18 and 18' are attached by their outside edges 7 and 7' to the rigid parts 5 and 5' and their alternating axial movement is transmitted to them by the mobile assembly M to which they are fastened at 33 and 33'. In this arrangement the flexible member 18 forms, so to speak, the mobile axial end wall of the variable volume chamber. This embodiment comprises the details already described with reference to FIG. 2 and concerning in particular the definition of the double enclosure by the bellows 15 and 15', the monitoring of the spaces 15A and 15'A by the pressure switch 16, and the parts such as the eccentric 11 constituting the caged eccentric assembly. As distinct from FIG. 2, the gas intake and outlet tubes are outside the pump body and provided with flap or blade type non-return valves **14*a***, these conventional solutions being specific to reciprocating pumps.

The reliability and performance of this type of completely dry pump are due to the considerable axial flexibility of the flexible members such as 18 and to the reduction of the fatigue effects to which they are subjected by lightly pressurizing their external surfaces in the fluid-tight annular spaces 15A and 15'A.

Figure 6:
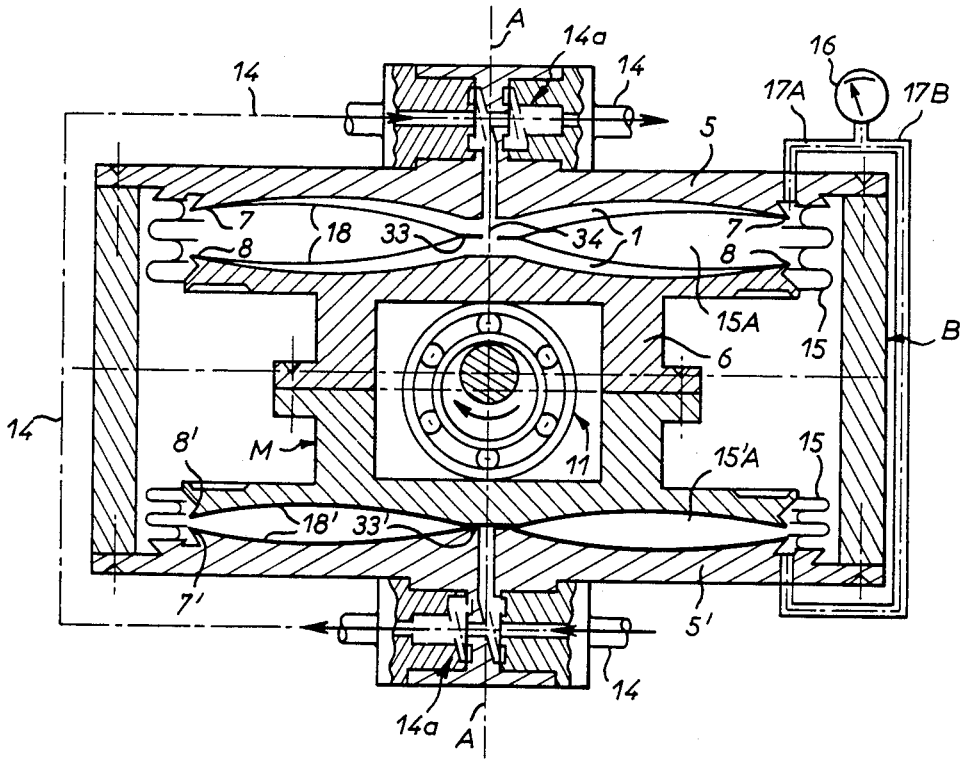
FIG. 6 is a view analogous to FIG. 5 but with a double flexible metal member as shown in FIG. 4.

FIG. 6 shows a dry pump structure identical to that shown in FIG. 5 but with a pumping member consisting of two elements 18 fastened together by their central parts 33 as shown in FIG. 4. These elements 18 and 18' are attached at their respective outside edges 7—7' and 8—8' to the fixed rigid parts 5 and 5' and to the part 6 which forms part of the mobile assembly M, which when acted on by the caged eccentric mechanism transmits to these flexible elements their axial alternating movement.

It will be noted that for the same work output from each of the two elements 18 of the member thus constituted the volume of the pumping chamber 1 is doubled as compared with the volume of a chamber equipped as in FIG. 5 with a single non-duplicated element 18. As the elements 18 move between the moved apart configuration and the moved together configuration, the hole 34 providing communication between the two parts of the chamber 1 enables all of the gases to be expelled. This design benefits from the various advantageous arrangements already mentioned in regard to the structure shown in FIGS. 2 and 5.

Figure 7:
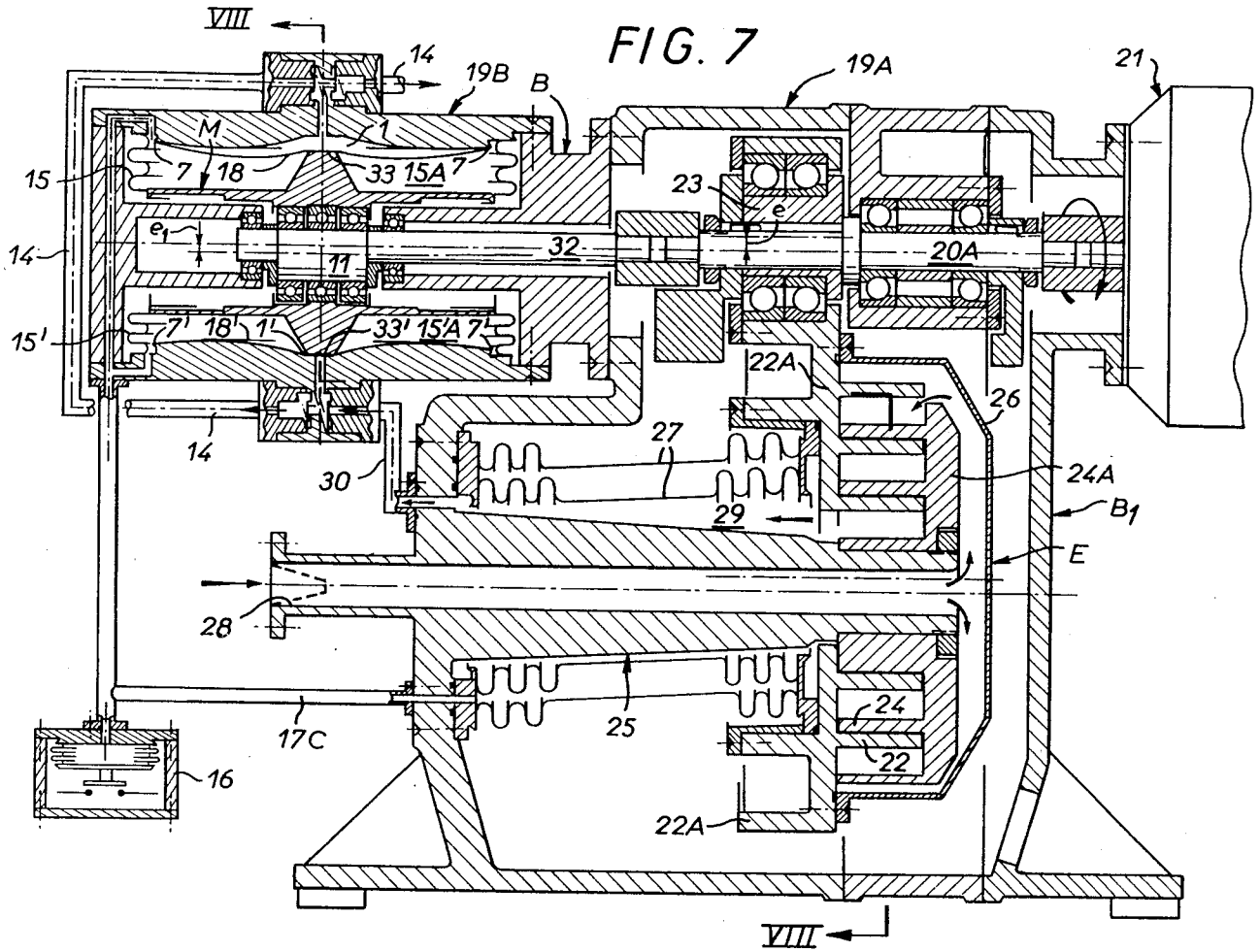
FIG. 7 is a view in cross-section on the line VII—VII in FIG. 8 of a completely dry and fluid-tight pumping set obtained by coupling together a pump as in FIG. 5 with a spiral pump operating in circular translation.
Figure 8:
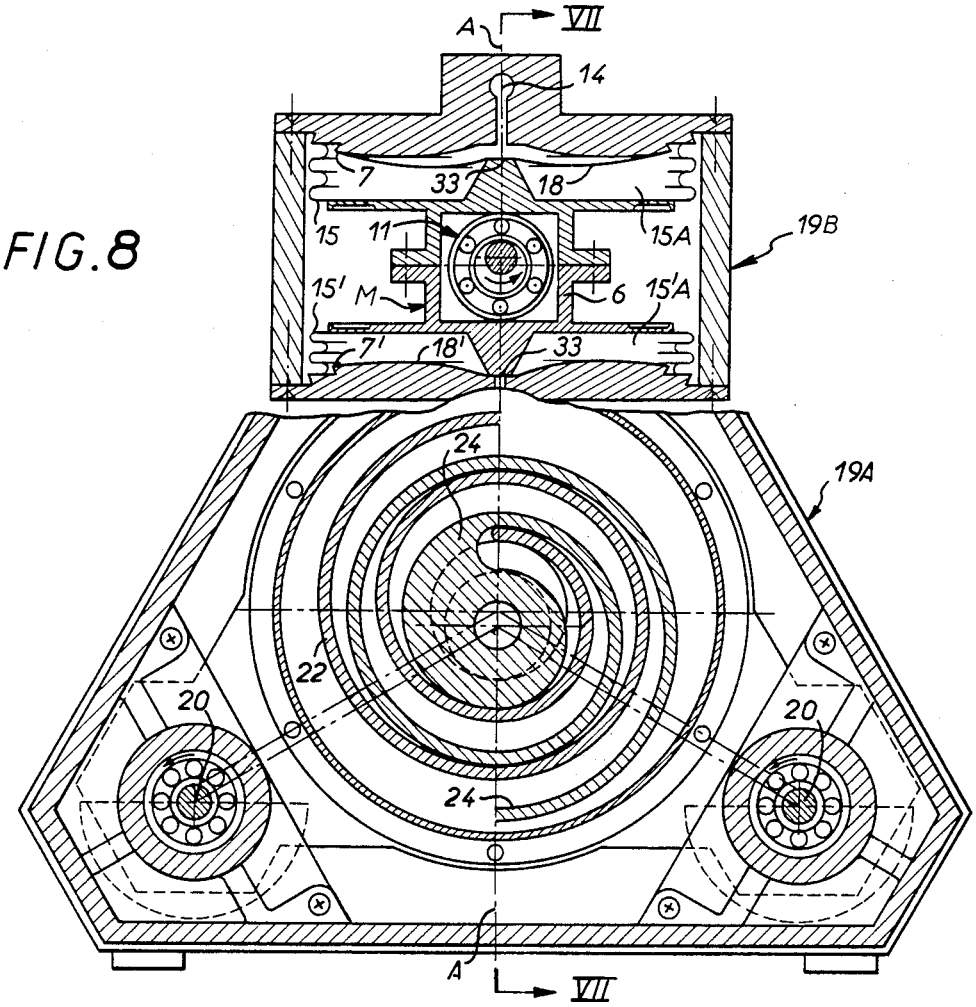
FIG. 8 is a view in cross-section on the broken line VIII—VIII in FIG. 7.

Although a completely dry fluid-tight pump of the aforementioned type may be utilized alone, it is advantageous to associate with it another pump, of the spiral type previously mentioned, for example. FIGS. 7 and 8 show a spiral pump 19A of this kind associated with a pump 19B of the type described above with reference to FIG. 5.

The spiral pump 19A, the principle of which is well known from the aforementioned patents in the name Paul Vulliez (in particular, Nos. FR-2 141 402 and FR-2 153 129, DE-2 225 327 and U.S. Pat. No. 3,802,809), is described only in outline hereinafter.

It comprises, in an enclosure closed by a bell member 26 and double bellows assembly 27, a fixed spiral 24 attached via a plate 24A to a gas intake barrel 25 and, interleaved therewith, a mobile spiral 22 driven in precise circular translation with a very small constant radial and axial clearance relative to the fixed spiral 24 and the associated baseplate 24A. The circular translation movement is communicated by three eccentrics 23 with the same eccentricity "e" fastened to three parallel shafts 20 and inserted by means of bearings in axial cavities in the part 22A carrying the mobile spiral 22.

One of the three shafts 20, the shaft 20A, is driven in rotation by a motor 21, the other shafts serving only to guide accurately the mobile spiral 22. The assembly is disposed within a frame B1.

The gases to be pumped are drawn into the tube 28 of the barrel 25 through a hose (not shown) connected to the chamber to be evacuated. They enter between the spirals at their periphery and, by virtue of compression between these spirals, are discharged towards the axis into an annular chamber 29 between the barrel 25 and the double bellows assembly 27.

These gases are then taken off via a tube 30 to the pumping chambers 1 and 1' of the pump 19B.

This pump 19B is analogous to the pump in FIG. 5, but is shown in FIG. 7 on a cross-sectional plane perpendicular to that of FIG. 5; corresponding components carry the same reference numbers as in FIG. 5.

As previously described, this pump discharges said gases to the atmosphere, into a container or into a circuit into which, in accordance with the invention and depending on the type of flexible member used, they may be transferred at a pressure higher than atmospheric pressure.

It will be noted that the eccentric 11 of the pump 19B (with eccentricity "$e_1$") is driven through the rotation of a shaft 32 aligned with the shaft 20A driven by the motor 21. The connection between the shafts 20 and 32 may be either direct or through any form of speed reducing system, the reciprocating compression pump 19B retaining sufficient efficiency at reduced speeds, given the small mass flowrate of the gases to be pumped at pressures where the predominant pumping action is that due to the spiral pump.

The volume situated between the two bellows of the double bellows assembly 27 is advantageously placed in communication, via a tube 17C and like the volumes 15A and 15'A situated between the flexible members 18 and 18' and the bellows 15 and 15', with a pressure switch 16 adapted to sense any leakage from the flexible members 27, 18—18', 15—15'.

The establishment, for testing purposes, of a pressure limited to a few tens of millibars in the fluid-tight annular spaces 15A and 15'A advantageously makes it possible to reduce significantly the effects of fatigue on the flexible members 18 the outside surfaces of which are thus shielded from the action of atmospheric pressure.

It will be understood that various changes in the details, materials and arrangements of parts which have been herein described and illustrated in order to explain the nature of the invention may be made by those skilled in the art within the principle and scope of the invention as expressed in the appended claims. This applies in particular to the specific structure of the flexible metal pumping members, the arrangement of the various pumping chambers within the same pump and the method of coupling a pump in accordance with the invention to another pump, particularly but not exclusively of the spiral type.

There is claimed:

1. A completely dry fluid-tight vacuum pump comprising at least one variable volume pumping chamber having an intake, an outlet, a fixed axial end wall and a mobile axial end wall, non-return means adapted to procure one-way flow of fluid from said intake to said outlet, one or two radially stiff and axially flexible circular metal members in said chamber having an outer part fixed relative to said fixed end wall and another part fixed relative to said mobile axial end wall, said circular metal members having opposite faces, said circular metal members being axially reciprocably movable between a first position in which said axial end walls are relatively axially remote from each other and a second position in which said axial end walls are relatively axially close together, one of the faces of said circular metal members being substantially entirely in intimate overlying relation with at least one of said end walls and having matching diametrical profiles with said at least one of said end walls in said second close together position, and minimal residual space being defined between said one face of said circular metal members and said at least one axial end wall in said second close together position while maintaining a very small clearance between said one face of said circular metal members and said at least one axial end wall.

2. Vacuum pump according to claim 1, wherein said one or two circular metal members has an inner face facing inwardly of said chamber and an outer face facing outwardly of said chamber, said inner face being substantially entirely in intimate overlying relation and having a matching diametral profile with said at least one end wall in said second position, said residual space being defined between said one face and said at least one end wall.

3. Vacuum pump according to claim 1, wherein said one end wall is said fixed axial end wall.

4. Vacuum pump according to claim 1, wherein said one or two circular metal members is out of contact with itself and out of contact with said axial end walls, except for the said outer part thereof and the said other part.

5. A completely dry fluid-tight vacuum pump comprising at least one variable volume pumping chamber having an intake, an outlet, a fixed axial end wall and a mobile axial end wall, non-return means adapted to procure one-way flow of fluid from said intake to said outlet;

a single radially stiff and axially flexible circular metal member of disclike configuration disposed in said chamber, said circular metal member having an outer part sealingly fixed relative to said fixed axial end wall and a central part fixed relative to said mobile axial end wall;

said single circular metal member being axially reciprocably movable between a first position in which said axial end walls are relatively axially remote from each other and a second position in which said axial end walls are relatively close together, said single circular metal member and said fixed axial end wall having matching diametrical profiles in said second close together position;

and minimal residual space being defined between said circular metal member and said fixed axial end wall in said second close together position while maintaining a very small clearance between said circular metal member and said fixed axial end wall.

6. A completely dry fluid-tight vacuum pump comprising at least one variable volume pumping chamber having an intake, an outlet, a fixed axial end wall and a mobile axial end wall, non-return means adapted to procure one way flow of fluid from said intake to said outlet and two radially stiff and axially flexible circular metal members in said chamber;

said mobile axial end wall forming part of a mobile assembly which is adapted to move axially to and from between a position with said axial end walls moved apart and a position with said axial end walls moved together to apply said circular members respectively to said axial end walls; said fixed axial end wall and said mobile axial end walls comprising annular openings, said circular metal members having an annular configuration with a substantially toroidal transverse cross-section, formed by two flexible metal annular diaphragms joined back-to-back at their inside circular edges and fabricated in a single piece, and outwardly open to define two outside circular edges; said two outside circular edges respectively fastened and sealed to said fixed axial end wall and to said mobile axial end wall, wherein in the moved together position said two annular circular metal members and the respective adjacent annular openings in said axial end walls against which they are applied toward have substantially the same diametrical profile;

such that the residual space between the circular members and the respective axial end walls is as small as possible while maintaining a very small clearance between said circular members and said respective axial end walls.

7. Vacuum pump according to claim 6, wherein both of said circular members are in intimate overlying relation and having matching diametrical profiles with the respective axial end walls in said second position, said minimal residual space being defined between said circular metal members and the respective axial end walls in said second position.

8. Vacuum pump according to claim 6, wherein said radially outwardly opening toroidal cross section is generally U-shaped.

9. Vacuum pump according to claim 1, 5 or 6 further comprising a metal bellows surrounding said one or two circular metal members in said at least one pumping chamber, said metal bellows being axially sealingly fixed relative to said fixed axial end wall and sealingly fixed relative to said mobile axial end wall so as to define an annular safety chamber separating said pumping chamber from the surroundings and means for maintaining said annular safety chamber at a pressure substantially less than that of the surrounding environment.

10. Vacuum pump according to claim 1, 5 or 6, wherein said pump comprises two variable volume pumping chambers, each comprising a mobile end wall which is part of a mobile assembly, and one eccentric mechanism for reciprocating said mobile assemblies.

11. Vacuum pump according to claim 1, 5 or 6, in combination with a completely dry and fluid-tight spiral vacuum pump, said spiral vacuum pump comprising a mobile spiral, a fixed spiral interleaved with said mobile spiral, three eccentrics with the same eccentricity, three parallel shafts attached to said eccentrics, and a motor coupled to one of said shafts, said mobile spiral being rotationally driven, a shaft on said eccentric mechanism being mounted on a further shaft with said shaft coupled to said motor, said eccentric mechanism being rotationally driven by said shaft coupled to said motor.

12. Vacuum pump according to claim 1, 5 or 6, wherein the diametrical profiles of said one or two circular metal members and said at least one end wall are such as to preclude any rubbing contact between portions of said one or two circular metal members.

13. A completely dry fluid-tight vacuum pump comprising at least one variable volume pumping chamber having an intake, an outlet, a fixed axial end wall and a mobile axial end wall, non-return means adapted to procure one way flow of fluid from said intake to said outlet and one radially stiff and axially flexible circular metal member in said chamber;

said mobile axial end wall forming part of a mobile assembly which is adapted to move axially to and fro between a position with said axial end walls moved apart and a position with said axial end walls moved together to apply said circular member to said fixed axial end wall;

said circular member comprising a single circular diaphragm which is attached and sealed at its outer edge to said fixed axial end wall and which is fixed at its central part to said mobile assembly, wherein in the moved together position said single circular diaphragm and said axial end wall against which it is applied toward have substantially the same diametrical profile;

such that the residual space between said circular diaphragm and said fixed axial end wall is as small as possible while maintaining a very small clearance between said circular diaphragm and said fixed axial end wall.

14. A completely dry fluid-tight vacuum pump comprising at least one variable volume pumping chamber having an intake, an outlet, a fixed axial end wall and a mobile axial end wall, non-return means adapted to procure one way flow of fluid from said intake to said outlet and two radially stiff and axially flexible circular metal members in said chamber;

said mobile axial end wall forming part of a mobile assembly which is adapted to move axially to and fro between a position with said axial end walls moved apart and a position with said axial end walls moved together to apply said two circular members respectively to said axial end walls;

said two circular metal members having similar central parts through which they are fastened together so that their respective diametrical profiles are substantially symmetrical relative to a transverse plane, said outside parts of said two metal members are respectively attached and sealed to said fixed axial end wall and to said mobile axial end wall, and having a passage formed in said fastened together central parts; wherein in the moved together position said circular metal members and the respective adjacent axial end wall against which it is applied towards have substantially the same diametrical profile;

such that the residual space between the circular metal members and the respective axial end walls is as small as possible while maintaining a very small clearance between said circular metal members and said respective axial end walls.

15. Vacuum pump according to claim 13 or 14 comprising a metal bellows in at least one pumping chamber which is axially attached and sealed to a fixed rigid part and axially attached and sealed to a mobile rigid part of the pump so as to define at least one annular safety chamber separating said pump chamber from the surrounding environment, and means for maintaining said annular safety chamber at a pressure significantly less than that of said surrounding environment.

16. Vacuum pump according to claim 13 or 14 wherein said pump comprises two variable pumping chambers.

17. A completely dry fluid-tight vacuum pump comprising at least one variable pumping chamber having an intake, an outlet, a fixed axial end wall and a mobile axial end wall, non-return means adapted to procure one-way flow of fluid from said intake to said outlet;

two radially stiff and axially flexible circular metal members disposed in said chamber and fixed to each other in their central parts and having an entirely free passage extending through said central parts, said two circular metal members having a radially outwardly opening toroidal configuration and being symmetrical relative to a radial plane, the outer part of one circular member being sealingly fixed relative to said fixed axial end wall and the outer part of the other circular member being sealingly fixed to said mobile axial end wall;

said circular members being axially reciprocably movable between a first position in which said axial end walls are relatively axially remote from each other and a second position in which said axial end walls are relatively axially close together, said circular members and said respective axial end walls having matching diametrical profiles in said second close together position;

and minimal residual space being defined between said circular metal members and said respective axial end walls in said second close together position while maintaining a very small clearance between said circular metal members and said respective axial end walls.

18. Vacuum pump according to claim 17, wherein said two circular metal members comprise two annular metal diaphragms joined along their radially inner periphery.

19. Vacuum pump according to claim 17 wherein said two circular metal members comprise two annular diaphragms joined back-to-back at their inside circular edges and fabricated in a single piece.

* * * * *